US008288638B2

(12) United States Patent
Fabas et al.

(10) Patent No.: US 8,288,638 B2
(45) Date of Patent: Oct. 16, 2012

(54) MULTI-PANEL GLASS ACOUSTICAL MUSICAL INSTRUMENT

(76) Inventors: Karl Henry Fabas, Southbury, CT (US); Steve Rowen, North Andover, MA (US)

( * ) Notice: Subject to any disclaimer, the term of this patent is extended or adjusted under 35 U.S.C. 154(b) by 5 days.

(21) Appl. No.: 12/820,397

(22) Filed: Jun. 22, 2010

(65) Prior Publication Data

US 2011/0308375 A1 Dec. 22, 2011

(51) Int. Cl.
*G10D 3/00* (2006.01)

(52) U.S. Cl. ..... 84/411 R

(58) Field of Classification Search ..... 84/411 R, 84/415, 416

See application file for complete search history.

(56) References Cited

U.S. PATENT DOCUMENTS

| | | | | |
|---|---|---|---|---|
| 2,338,816 | A | 1/1944 | Lockhart | |
| 3,680,425 | A * | 8/1972 | Morena et al. | 84/411 R |
| 4,184,407 | A * | 1/1980 | Townshend | 84/411 R |
| 4,577,541 | A | 3/1986 | Edge | |
| 6,060,651 | A | 5/2000 | Basmadjian | |
| 7,498,498 | B2 | 3/2009 | Lerner | |
| 2002/0029680 | A1 | 3/2002 | Cleland | |
| 2003/0061929 | A1 | 4/2003 | Dye | |
| 2006/0272478 | A1 | 12/2006 | Steinhour | |
| 2007/0283797 | A1 * | 12/2007 | Crawford et al. | 84/411 R |
| 2008/0223194 | A1 * | 9/2008 | Okamoto | 84/411 R |
| 2008/0264235 | A1 | 10/2008 | Lerner | |

FOREIGN PATENT DOCUMENTS

CN 201111873 Y * 9/2008

* cited by examiner

*Primary Examiner* — Kimberly Lockett
(74) *Attorney, Agent, or Firm* — Verrill Dana, LLP; Chris A. Caseiro

(57) ABSTRACT

A multi-panel glass acoustic instrument is provided, wherein the body of the instrument includes a polygon made of flat pieces joined together. In one embodiment, the flat pieces are formed from glass. In a preferred embodiment, the instrument is a drum, wherein the drum shell is fabricated from a plurality of flat pieces of glass that are bonded together. The drum shell may include one or more rim caps for positioning between the edges of the glass panels and the drum head or heads. In a preferred embodiment, the instrument is a snare drum. The musical instruments of the present invention provide functional, audio, and aesthetic improvements over instruments known in the art.

15 Claims, 6 Drawing Sheets

10

MULTI-PANEL GLASS ACOUSTICAL MUSICAL INSTRUMENT

BACKGROUND OF THE INVENTION

1. Field of the Invention

The present invention relates generally to acoustical musical instruments. More particularly, the present invention relates to drums formed as a multi-panel polygon. Still more particularly, the drums are fabricated from a plurality of flat pieces of glass that are joined together. The musical instruments of the present invention provide functional, audio, and aesthetic improvements over instruments known in the art.

2. Description of the Prior Art

Musical instruments can be broadly divided into percussion, string, and wind instruments. The drum is a member of the percussion group of musical instruments. Drums consist of at least one membrane, called a drum head or drum skin, that is stretched over the drum shell and struck, either directly with the musician's hands, or with a drumstick or brushes, to produce sound. Drums are the oldest and most ubiquitous musical instruments in the world, and the basic design has remained virtually unchanged for thousands of years.

Often, several drums are arranged together to create a drum kit. Within the drum kit, the snare drum is often considered to be the most important instrument, because of the unique sound created and the fact that most beats are based around the timing of the snare drum. With that in mind, it is crucial that the sound of the snare drum stand out from the other drums played. Snare drums are also often played on their own.

The snare drum is a drum with two drum heads, with strands of snares made of curled metal wire, metal cable, plastic cable, or gut cords stretched across one of the drum heads, typically the bottom (or resonance) drum head. Pipe and tabor and some military snare drums often have a second set of snares on the bottom (internal) side of the top (batter) drum head to make a "brighter" sound, and the Brazilian caixa commonly has snares on the top of the upper drum head. Snare drums will often have a strainer on one side and a butt plate on the other to hold the snare wires to the drum head. Snare tension is controlled with a screw on the strainer. A strainer may also have a throw-off lever to deactivate and move the snares away from the drum head in order to achieve a different sound.

Previously, drum shells have been fabricated from many different materials, such as wood, metal, carbon fiber, or plastic resins. Drum shells are invariably cylindrical, with an opening over which a drum head is stretched. The drum head is placed over the opening of the drum, which in turn is held onto the shell by a counter-hoop or rim, which will be referred to herein as the hoop. There are typically two hoops for a snare drum, for example, a first one to releasably retain a first drum head to a first perimeter of the drum shell, and a second one to releasably retain a second drum head to an opposing second perimeter of the drum shell. The hoop is releasably retained to the drum shell by means of a number of tuning screws called tension rods which screw into lugs placed evenly around the perimeter of the shell. The head's tension can be adjusted by loosening or tightening the rods. Many such drums have six to ten tension rods.

The sound of a drum depends on several variables, including shape, size and thickness of its shell, materials from which the shell is made, counter-hoop material, type of drum head used and tension applied to it, position of the drum, location, and the velocity and angle at which the head is struck.

Although drums known in the art are functional, problems do occur. For example, wooden drums may be subject to deterioration as a result of exposure to environmental dampness. When this occurs, the tones produced will vary and render the drum unsatisfactory for further use. Materials that may be required to create a desired sound, such as a particularly dense wood, may be unworkable into the requisite cylindrical drum shell. Similarly, very thick metal may result in a desired sound, but the drum would be largely unusable due to weight.

As such, it is clear there exists a continuing need in the art for improved drum shells. Furthermore, there is an on-going need in the musical community to create new sounds. In that regard, there exists in the musical world acoustical instruments that are intentionally designed without flat reverberation surfaces for the apparent purpose of enhancing sound quality. In particular, prior to the present invention, it has been the generally held belief that acoustical instruments should not include flat reverberation surfaces. The present inventors have determined that the introduction of flat surfaces to acoustical instruments for the purpose of generating distinct sounds is of interest.

SUMMARY OF THE INVENTION

It is an object of the present invention to provide an improved body for acoustical instruments, including percussive instruments, wherein the body is made of a plurality of flat surfaces joined together. The flat surfaces are joined together to form a multi-paneled polygon to serve as a shell for the instrument. Any suitable material may be used to form the flat surfaces, such as metal, wood, plastic resins, carbon fiber, or glass. In one embodiment, the flat surfaces are made of glass. In a preferred embodiment the flat, glass surfaces form a drum shell. The drum shell is combined with standard pieces such as lugs, hoops, tension rods, and drum heads known in the art to create a drum. In a preferred embodiment, the glass drum shell is combined with elements known in the art to construct a snare drum.

Drums according to the present invention provide significant improvements over drums known in the art. The flat-sided multi-panel drum shell provides unique acoustics unachievable with any drum shell known in the art. Constructing the flat-sided drum shell out of glass also results in unique acoustics. Glass drum shells are also extremely durable and not subject to damage from moisture or the like. Furthermore, a glass drum shell provides a distinctive look to drums constructed with such shells, which is an aesthetic achievement unavailable without the present invention. More generally, the present invention is an acoustical instrument comprising a primary body formed of a plurality of flat panels joined together, wherein the resultant instrument is capable of generating sounds that cannot be generated by acoustical instruments made with the primary body having only non-flat surfaces.

These and other objects of the present invention will be more fully understood upon review of the following detailed description, the accompanying drawings, and the appended claims.

DETAILED DESCRIPTION OF THE PREFERRED EMBODIMENTS OF THE INVENTION

Figure 1:
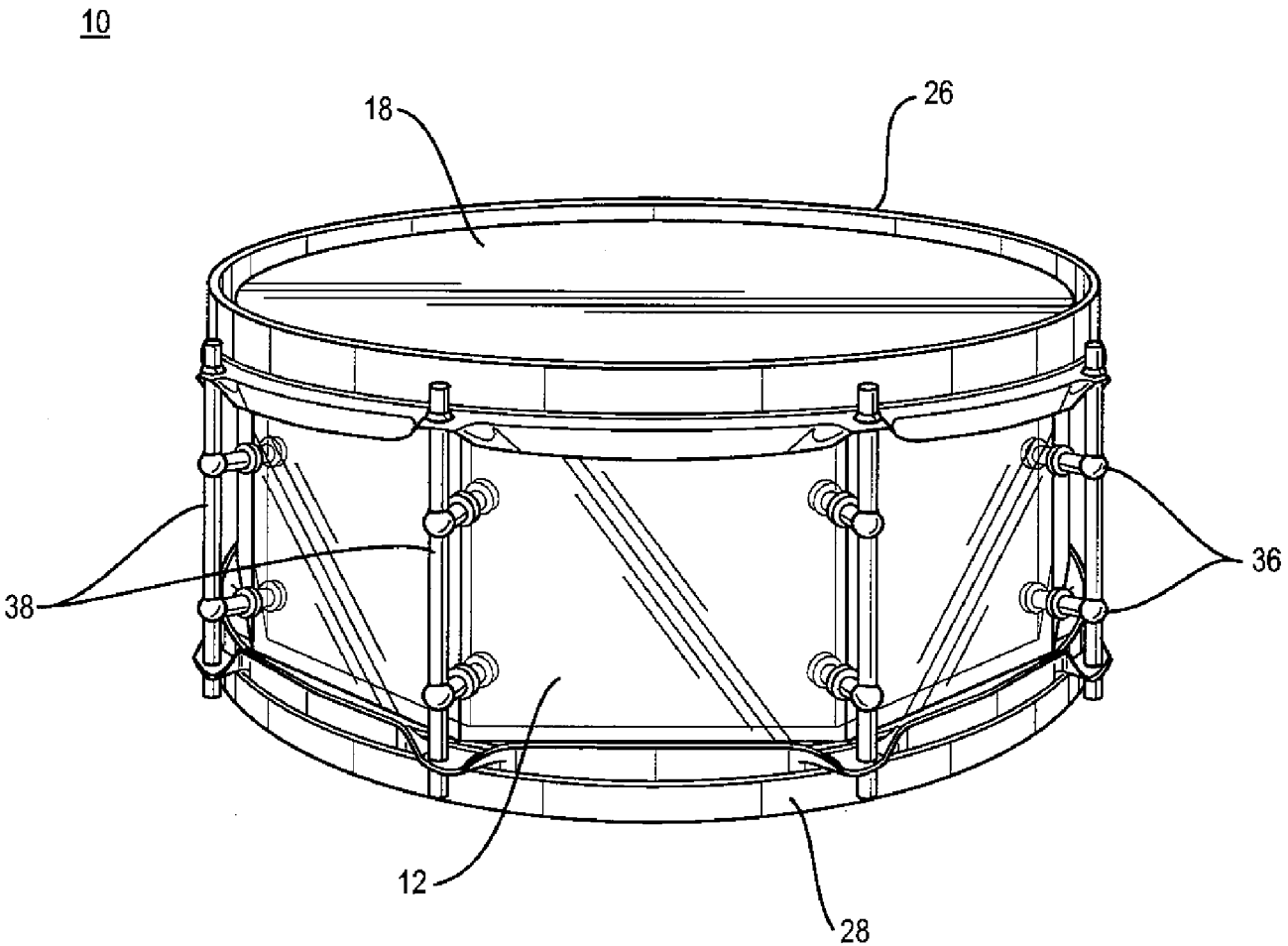
FIG. 1 is a schematic, perspective view illustrating the top and side of a snare drum constructed according to the present invention.
Figure 2:
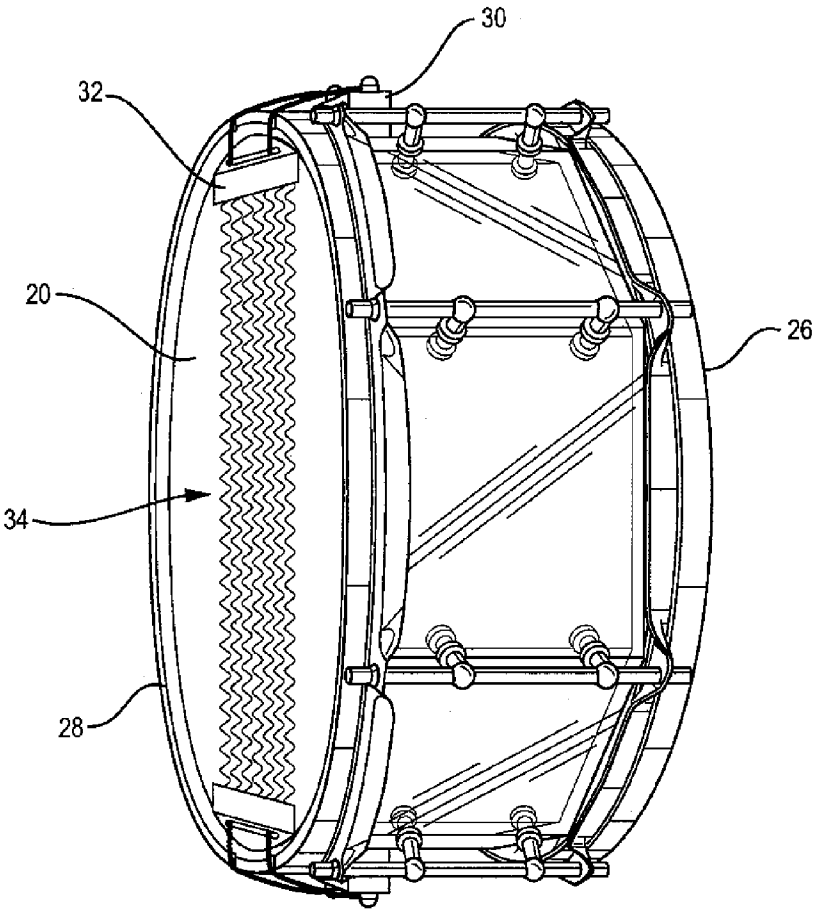
FIG. 2 is a schematic, perspective view of the bottom and side of the snare drum of FIG. 1 showing the snares stretched across the bottom drum head.

A musical instrument with flat-sided bodies or shells of the present invention will now be discussed in more detail with reference to a particular embodiment. Referring to FIGS. 1 and 2, a preferred embodiment of the present invention made of glass, a snare drum 10, is depicted. The drum 10 includes a first drum head 18, a second drum head 20, a first drum head retaining hoop 26 for removably retaining the first drum head 18 to drum shell 12, and a second drum retaining hoop 28 for removably retaining the second drum head 20 to the drum shell 12. The drum 10 also includes as standard hardware a butt plate 30 and a strainer 32 to removably hold snares 34 in place. The hoops 26/28 are joined together around the drum shell 12 using screws or lugs 36 and tension rods 38. The drum shell 12 includes one or more ports, which may be positioned at the adjoining edges of adjacent glass panels further described herein, through which the lugs 36 pass and are removably retained therein. The hoops 26, 28, butt plate 30, and strainer 32 attach to the bottom rim of the drum shell 12. The strainer 32 holds the snares 34 in position and may have a control switch that allows for the disengagement of the snares 34, while the butt plate 30 holds them fixed on the other side. The hoops 26, 28 hold the drum heads 18, 20 in place and tension associated with the drum heads 18/20 is regulated through adjustment of the tension rods 38. Any suitable drum heads 18, 20 or snares 34 may be used with the drum shells 12 of the present invention.

Figure 3:
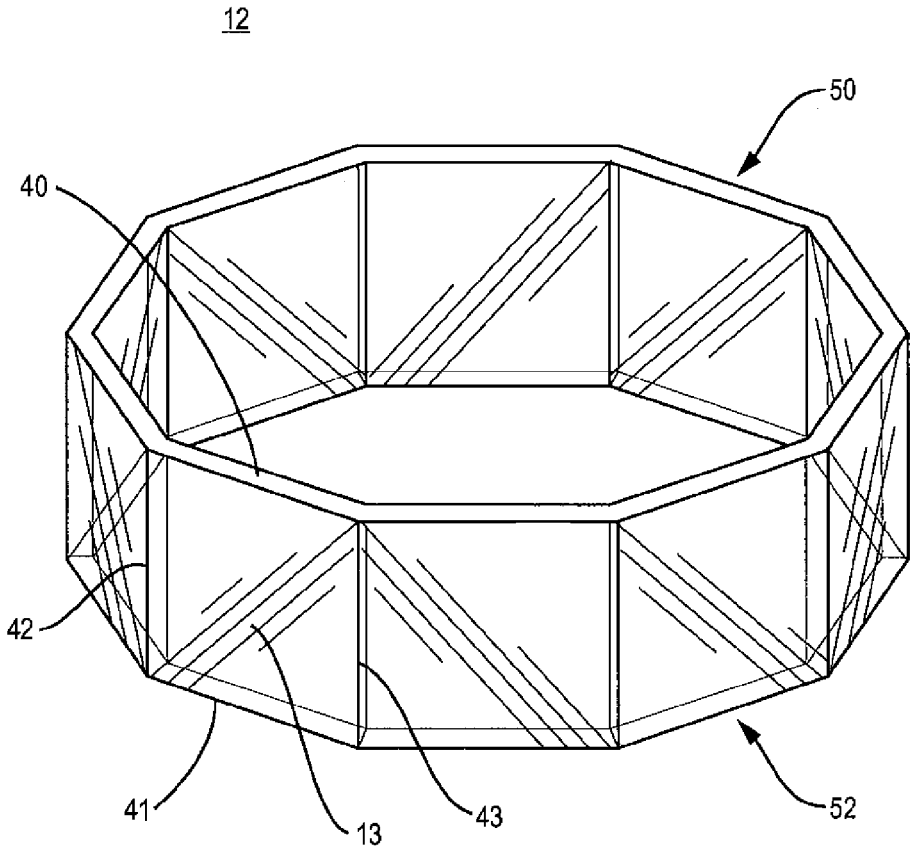
FIG. 3 is a perspective view of the glass panels of the drum shell of the drum joined together and no other drum hardware connected to the glass panels.

As shown in FIG. 3, the drum shell 12 of the drum 10 is made of ten pieces of flat glass panels 13, each having a perimeter formed of a top edge 40, a bottom edge 41, a first side edge 42 and a second side edge 43. The pieces of glass panels 13 are joined together at their perimeter edges 42 and 43. That is, for example, by joining the first side edge 42 of one piece of glass panel 13 to the second side edge 43 of an adjacent piece of glass panel 13, and so forth until all pieces are joined at their first and second side edges 42/43 to adjacent pieces of glass panels 13. The joining may be accomplished in any manner suitable to ensure that the panels 13 remain attached to one another for the intended purpose of establishing the drum shell 12. Joining options include, but are not limited to, methods known to those skilled in the art of glass making, or bonding the panels 13 together, such as with an adhesive suitable to attach pieces of glass together. The panels 13 are adhered via ultraviolet-activated bonding glue or comparable strength glue. Any suitable glass may be used. In the snare drum 10 of FIGS. 1 and 2, ½ inch thick glass was used. Drum shells 12 of the present invention may be made into any suitable polygonal shape by joining together an appropriate number of glass panel pieces at the appropriate angles. For example, eight pieces of glass panels 13 may be joined together into an octagonal drum shell, or twelve pieces of glass panels 13 may be joined together into a dodecagonal drum shell, and so on. When the panels 13 are joined together, the drum shell 12 has a first edge perimeter 50 for retaining thereon a first drum head and a second edge perimeter 52 for retaining thereon a second drum head.

The construction of the multi-panel drum shell 12 of the present invention with flat surfaces rather than the standard cylindrical form results in a drum 10 that when completed and struck generates a unique sound unattainable through the use of standard materials and cylindrical drum shells. It is contemplated that similar types of such unique sounds may also be generated in other types of acoustical instruments ordinarily formed with cylindrical sound producing bodies by making such instruments with a plurality of flat surfaces. Therefore, the present invention is not intended to be limited to drums alone. Additional unique acoustical qualities may be achieved by constructing the multi-panel bodies from glass.

Figure 6:
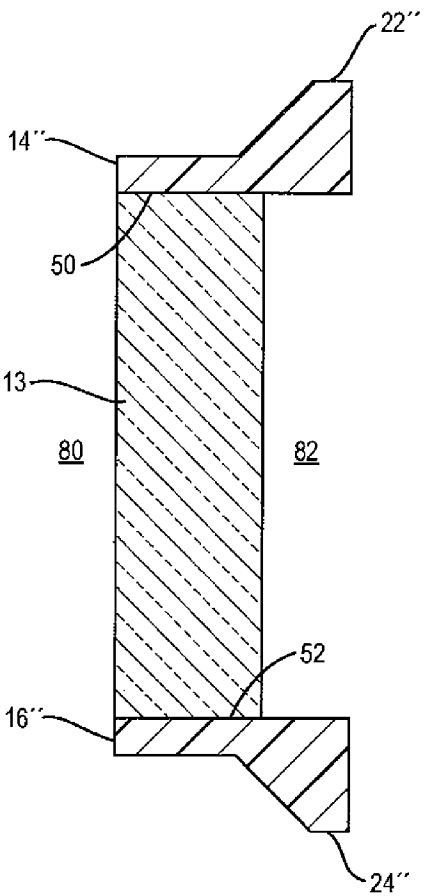
FIG. 6 is a cross-sectional side view of a panel of the drum shell of the present invention with a third rim cap design joined to the drum shell at the first and second perimeters wherein the drumhead-facing bearing edges are stepped and angled.
Figure 5:
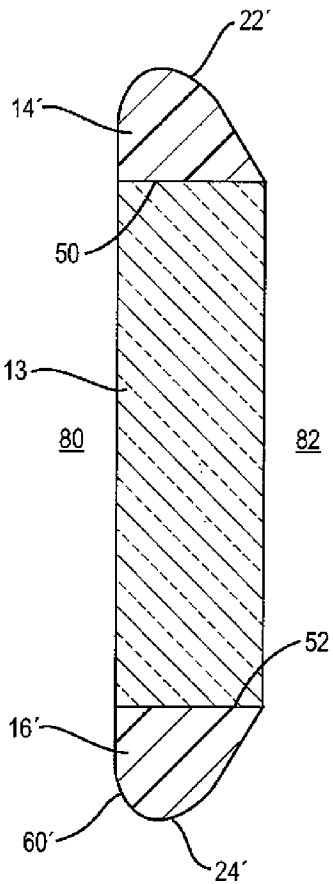
FIG. 5 is a cross-sectional side view of a panel of the drum shell of the present invention with a second rim cap design joined to the drum shell at the first and second perimeters wherein the drumhead-facing bearing edges are curved.
Figure 4:
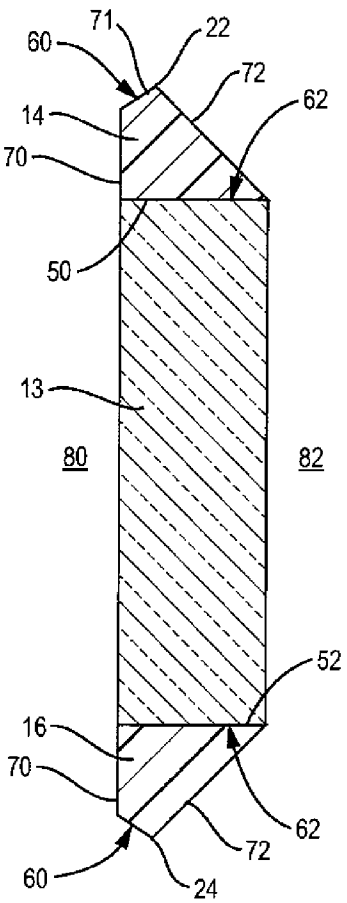
FIG. 4 is a cross-sectional side view of a panel of the drum shell of the present invention with a first rim cap design joined to the drum shell at the first and second perimeters wherein the drum head bearing edges are angled.

With continuing reference to FIG. 3, a first edge perimeter 50 and a second edge perimeter 52 of the drum shell 12 may form the bearing surfaces for the drum heads that are to be struck by the musician. However, as it is commonly a desire of the musician to have effective drum head tension, rim caps may be applied to either or both of perimeters 50 and 52 to blunt the sharpness of the interfaces of the joined panels 13 at first and second side edges 42 and 43. A first design of a rim cap suitable for that purpose is shown in FIG. 4, while alternative embodiments are shown in FIGS. 5 and 6. A first rim cap 14 is provided that may be joined to the first edge perimeter 50 of the drum shell 12. A second rim cap 16 may also be provided, which may be joined to the second edge perimeter 52 of the drum shell 12. In general, it is to be noted that at least the first rim cap 14 is employed in association with the surface where drum sticks contact the drum 10. As shown in FIG. 4, a first embodiment of the design of the first rim cap 14 and the second rim cap 16 are joined to the drum shell 12 at the first edge perimeter 50 and the second edge perimeter 52, respectively. In the case of the snare drum 10 example of the present invention, the first rim cap 14 and the second rim cap 16 are necessary because two drum heads 18, 20 are used. In a drum with a single drum head, for example, only one of the two rim caps 14, 16 would be used.

Figure 7:
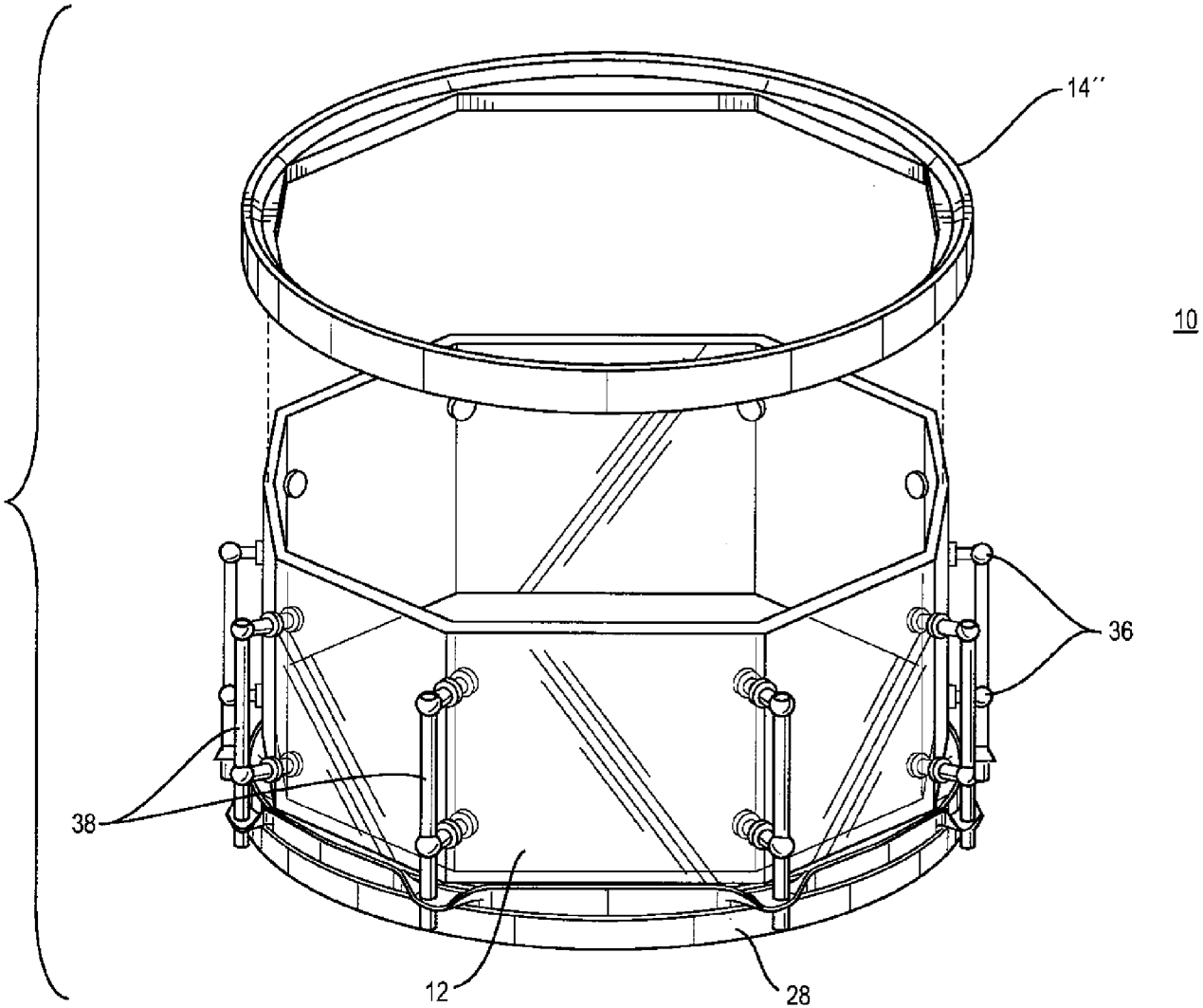
FIG. 7 is a perspective partially exploded view of the drum of the present invention showing the rim cap spaced away from the drum shell.
Figure 8:
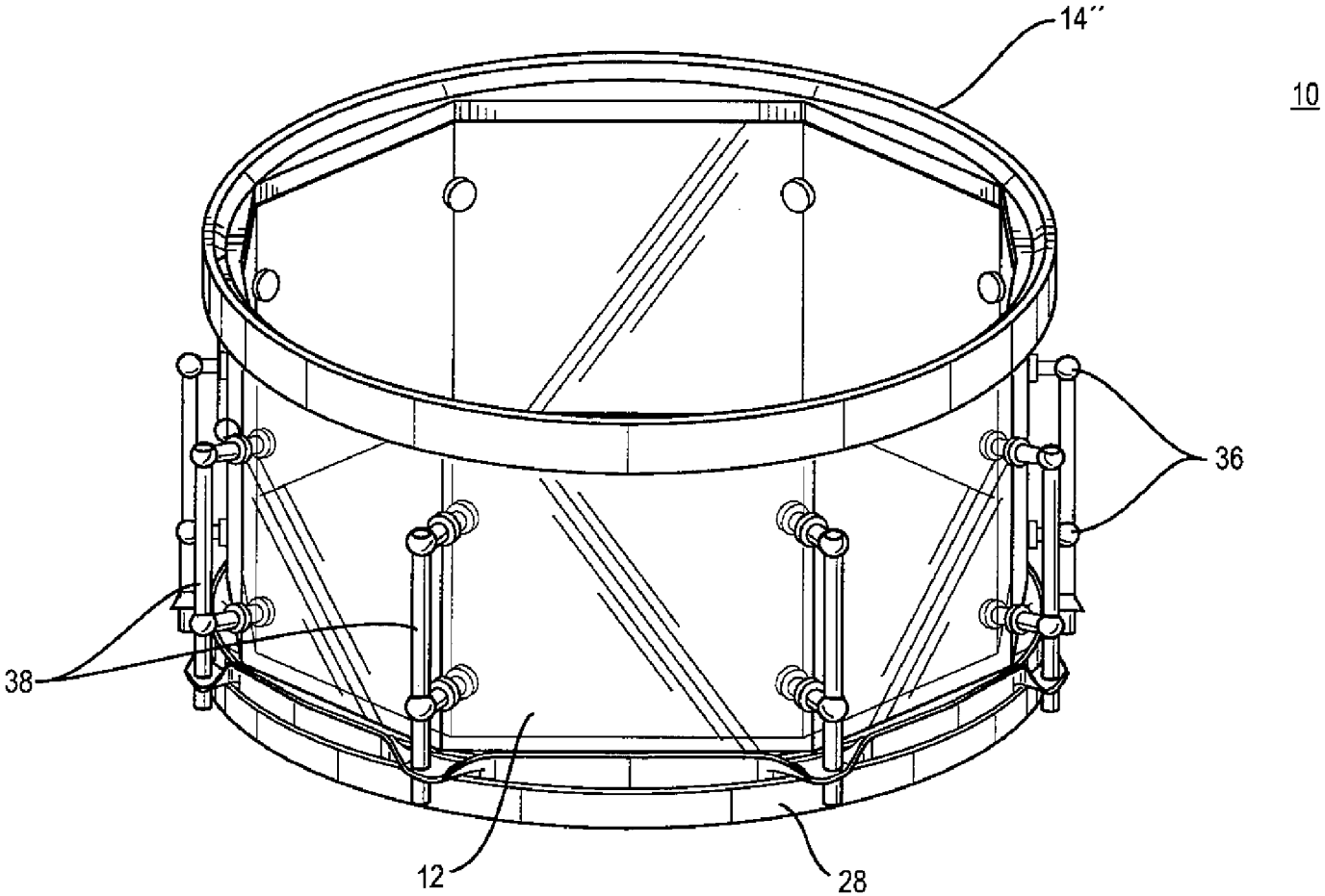
FIG. 8 is a perspective view of drum of the present invention showing the rim cap joined to the drum shell.

The rim caps 14, 16 are designed to have direct contact with the drum heads 18 and 20 as they are positioned between the heads 18 and 20 and the first edge perimeter 50 and the second edge perimeter 52 of the drum shell 12 to act as the bearing surfaces for the heads 18, 20. The rim caps 14, 16 are fabricated with a first surface 60, which is the surface of the rims 14, 16 directly contacting the heads 18, 20 when the drum 10 is made. The first surface is in the form of a circular perimeter as can be seen in FIGS. 7 and 8 with respect to the third example embodiment of the rim caps. The rim caps 14, 16 of the first embodiment are also fabricated with a second surface 62 in the form of a polygon corresponding in shape and size to the polygonal shape of the drum shell 12, which second surface 62 directly contacts the perimeter edges 50, 52 of the glass panels 13 of the drum shell 12. That is, the first surface 60 establishes a cylindrical shape of the drum 10 where the drum heads 18, 20 are retained to the drum shell 12 by hoops 26, 28. The rim caps 14, 16 are preferably made out of any suitable material known in the art having characteristics of sufficient structural strength to maintain the perimeter dimensions of the drum 10 while having sufficient flexibility not to crack after the repetitive striking that occurs with use of a drum. For example, polycarbonate may be used. It is to be noted that each of the rim caps 14, 16 may be fabricated as a single structure or in multiple pieces that are joined together, provided the second surface 62 matches the perimeter edges 50, 52 of the drum shell 12, and the first surface 60 is circular. This may be achieved by casting the rim caps 14, 16 in such shapes, or by machining them into such shapes.

The rim caps 14, 16 are joined to the drum shell 12 using any suitable joining mechanism known to those of skill in the art. For example, the joining may be accomplished by bonding using a bonding material adequate to retain the rim cap material to the glass panels. As noted, the rim caps 14, 16 are desirable components of the drum shell 12 to reduce the possibility of drum head failure caused by sharp edges of the glass panels 13. In the first embodiment of the rim caps 14, 16 represented in FIG. 4, a first bearing edge 22 at the first perimeter edge 50 of the drum shell 12 is typically configured with a first leg 70 extending upward from the first perimeter edge 50 at an interior portion 80 thereof, a second leg 71 angled upwardly and toward an exterior portion 82 of the first perimeter edge 50 and away from the interior portion 80 at approximately a 45° angle, and a third leg 72 angled downwardly toward the exterior portion 82 of the first perimeter edge 50 at approximately a 45° angle until contacting the portion of the first perimeter edge 50 associated with the exterior portion 82. The third leg 72 preferably begins at a point roughly 30 percent of the thickness of the glass panel 13 from the interior portion 80 to the exterior portion 82. This configuration of the rim cap 14 allows for the drum head 18 to transfer vibration to the drum shell 12 when it is tightened over the edge while minimizing possible tearing of the drum head 18 at contact bearing edge 22.

Rim cap 16 is similarly configured, with contact bearing edge 24 at the bottom of the drum shell 12. As shown in FIG. 2, the rim cap 16 further preferably includes two depressions, dips or wells on opposing sides of the drum shell 12 where the snares 34 are attached to the drum shell 12 such that the snares 34 are positioned in the depressions when placed on the drum head 20. This helps the snares 34 to lie flat on the drum head 20 when the drum head is tensioned. It is appreciated that this is merely one representative example of a suitable bearing edge construction. The invention is intended to encompass other embodiments as well, as different bearing edges may be used to create different types of sound. For example, a second embodiment of the rim caps is shown in FIG. 5, in which rim caps 14' and 16' include curved constructions, wherein the drum heads 18 and 20 make contact at curve peaks 22' and 24', respectively. Further, a third embodiment of the rim caps is shown in FIG. 6, in which rim caps 14" and 16" are stepped and angled, wherein the drum heads 18 and 20 make point contact at contact edges 22" and 24", respectively.

As shown in FIG. 7, the fabricated rim caps represented by third embodiment rim cap 14" may be placed on the perimeter edges of the drum shell 12, resulting in a rounded drum head contact surface while maintaining the multi-paneled structure of the drum shell 12 so as to provide an effective sound chamber of the drum 10. With reference to FIG. 8 and FIGS. 1 and 2, after the glass drum shell 12 and rim cap or rim caps 14, 16 are joined together, the drum 10 is completed according to methods and with materials known in the art. As a representative, non-limiting example the following discussion is included. The standard hardware known in the art is attached to the drum shell 12 with the screws or lugs 36. The hoops 26, 28, butt plate 30, and strainer 32 are attached to the bottom perimeter 52 of the drum shell 12. The drum heads 18, 20 and snares 34 are attached and tensioned as desired.

The present invention has been described with respect to various examples. Nevertheless, it is to be understood that various modifications may be made without departing from the spirit and scope of the invention. All equivalents are deemed to fall within the scope of this description of the invention.

What is claimed is:

1. An acoustic instrument having a body including a plurality of flat panels joined together to form a polygonal shape, wherein the polygonal-shaped body includes a first perimeter and a second perimeter, the instrument further comprising a rim cap joined to the first perimeter wherein the rim cap includes a first surface in a circular shape and a second surface in a shape corresponding to the polygonal-shaped body, wherein the rim cap is joined to the polygonal-shaped body at the second surface.

2. The instrument of claim 1 wherein the polygonal-shaped body is a drum shell and the instrument includes at least one drum head secured to the drum shell.

3. The instrument of claim 2 wherein the instrument is a snare drum.

4. The instrument of claim 1 further comprising a second rim cap joined to the second perimeter.

5. The instrument of claim 1 wherein the rim cap is angled.

6. The instrument of claim 1 wherein the rim cap is curved.

7. The instrument of claim 1 wherein the plurality of flat panels are joined together by bonding.

8. The instrument of claim 1, wherein the flat panels are made of glass.

9. The instrument of claim 2, wherein the flat panels are made of glass.

10. A drum comprising a drum shell made of glass without any additional structure to support or retain the drum shell, wherein the glass of the drum shell does not include a plastic resin.

11. The drum of claim 10, wherein the drum shell is of a polygonal shape formed of a plurality of flat panels of glass joined together.

12. The drum of claim 11, wherein the drum shell includes a rim perimeter, the drum further comprising a rim cap joined to the rim perimeter of the drum shell, wherein the rim cap includes a first surface in a circular shape and a second surface in a shape corresponding to the polygonal shape of the drum shell, wherein the rim cap is joined to the drum shell at the second surface.

13. The drum of claim 12, wherein the rim cap is angled.

14. The drum of claim 12, wherein the rim cap is curved.

15. The drum of claim 11, wherein the plurality of flat panels are joined together by bonding.

* * * * *